United States Patent [19]

Schmidt

[11] 4,330,400

[45] May 18, 1982

[54] APPARATUS FOR SEPARATING DUST, DIRT AND THE LIKE FROM PARTICULATE MATERIAL

[76] Inventor: Willibald Schmidt, Eichstätter St. 49, D-8432 Beilngries, Fed. Rep. of Germany

[21] Appl. No.: 230,006

[22] Filed: Jan. 30, 1981

[30] Foreign Application Priority Data

Jan. 30, 1980 [DE] Fed. Rep. of Germany ..... 3003308

[51] Int. Cl.[3] ..... B07B 3/02

[52] U.S. Cl. ..... 209/474; 209/34; 209/499; 209/502

[58] Field of Search ..... 209/474, 502, 499, 488, 209/138, 139 R, 136, 137, 34–37, 26–29, 476, 489, 1, 152, 22, 23

[56] References Cited

U.S. PATENT DOCUMENTS

| | | | |
|---|---|---|---|
| 21,945 | 11/1858 | Cox | 209/138 |
| 250,983 | 12/1881 | Skaden . | |
| 372,015 | 10/1887 | Davis . | |
| 482,424 | 9/1892 | Day | 209/502 X |
| 490,285 | 1/1893 | Higginbottom | 209/29 |
| 556,148 | 3/1896 | Higginbottom | 209/29 |
| 616,189 | 12/1898 | Huntley | 209/139 R |
| 850,959 | 4/1907 | Och | 209/139 R |
| 1,517,596 | 12/1924 | Stebbins | 209/474 |
| 1,597,261 | 8/1926 | Bishop | 209/138 X |
| 1,801,195 | 4/1931 | Fraser | 209/474 |
| 2,000,472 | 5/1940 | Erdmann | 209/27 |
| 2,001,331 | 5/1935 | Peale | 209/499 X |
| 2,477,935 | 8/1949 | Miller | 209/23 |
| 2,713,942 | 7/1955 | Von Rechenberg | 209/22 |
| 2,952,357 | 9/1960 | Berg | 209/138 |
| 3,061,096 | 10/1962 | Wyer | 209/26 |
| 3,255,882 | 6/1966 | McCarty et al. | 209/1 |
| 3,348,676 | 10/1967 | Karlsson et al. | 209/22 |
| 3,349,912 | 10/1967 | Eveson | 209/502 X |
| 3,655,043 | 4/1972 | Wochnowski et al. | 209/138 |
| 4,178,232 | 12/1979 | Nollet | 209/152 |
| 4,211,641 | 7/1980 | Jager | 209/139 A |

FOREIGN PATENT DOCUMENTS

| | | | |
|---|---|---|---|
| 172223 | 2/1952 | Austria | 209/474 |
| 624488 | 7/1961 | Canada | 209/474 |
| 1327882 | 4/1967 | France | 209/36 |
| 1011207 | 11/1965 | United Kingdom | 209/139 |

*Primary Examiner*—Robert Halper

*Attorney, Agent, or Firm*—Dann, Dorfman, Herrell and Skillman

[57] ABSTRACT

An apparatus for separating dust, dirt and the like from particulate material utilizes a flow of carrier fluid which passes through the particulate material on a grid or screen. The heavier particulate material falls through the grid while the lighter material as well as the dust, dirt and the like are entrained in the fluid and carried upwardly. A portion of the entrained material precipitates out of the carrier fluid into a vertical collecting bin whereupon it is discharged into another flow of carrier fluid. A sensor within the collecting bin senses the level of the collected precipitated material and reduces the velocity of the carrier fluid when the material in the collecting bin exceeds a predetermined level.

5 Claims, 3 Drawing Figures

APPARATUS FOR SEPARATING DUST, DIRT AND THE LIKE FROM PARTICULATE MATERIAL

BACKGROUND OF THE INVENTION

The present invention relates generally to an apparatus for separating dust, dirt and the like from particulate material utilizing a flow of carrier fluid and, more particularly, to such an apparatus in which the flow of the carrier fluid is controlled.

Apparatus of this type is generally well known in the art. However, the prior art separating apparatus requires constant supervision and adjustment of the airflow and particulate material flow through the apparatus in order to provide for efficient operation of the apparatus despite variations in the particle size of the incoming particulate material. The present invention maintains a high level of separator apparatus efficiency without the need for constant supervision and/or adjustment of the various flows through the apparatus due to changes in particle size.

SUMMARY OF THE INVENTION

Briefly stated, the present invention provides an apparatus for separating dust, dirt and the like from particulate material utilizing a flow of carrier fluid. The apparatus comprises a housing having a fluid inlet proximate to the bottom and a fluid outlet proximate to the top. A screen or grid means is disposed within the housing intermediate the fluid inlet and the fluid outlet. Inlet means are provided for introducing particulate material into the housing above the grid means and means are provided to cause a regulated velocity of carrier fluid to flow upwardly through the grid means toward the fluid outlet whereby heavier particulate material falls through the grid means and lighter particulate material is carried by the fluid passing upwardly through the grid means to thereby entrain and remove dirt, dust and light particles from the particulate material. A generally vertical collecting bin having an outlet positioned to collect a portion of the entrained particulate material precipitating from the upwardly passing carrier fluid, is also located within the housing. The collecting bin has an outlet for discharging the collected particulate material into a generally vertical separator conduit. The separator conduit has a fluid inlet below the collecting bin whereby fluid passes upwardly through the separator conduit to entrain dust, dirt and light particles from the material discharged from the collecting bin. A sensor means within the collecting bin senses the level of material located within the bin. Control means actuated by the sensor means controls the velocity of the carrier fluid flowing through the housing and operates to reduce the velocity of the carrier fluid when the material in the collecting bin exceeds a predetermined level.

BRIEF DESCRIPTION OF THE DRAWING

The foregoing summary, as well as the following detailed description of a preferred embodiment of the invention will be understood when read in conjunction with the appended drawings, in which.

DESCRIPTION OF A PREFERRED EMBODIMENT

Figure 1:
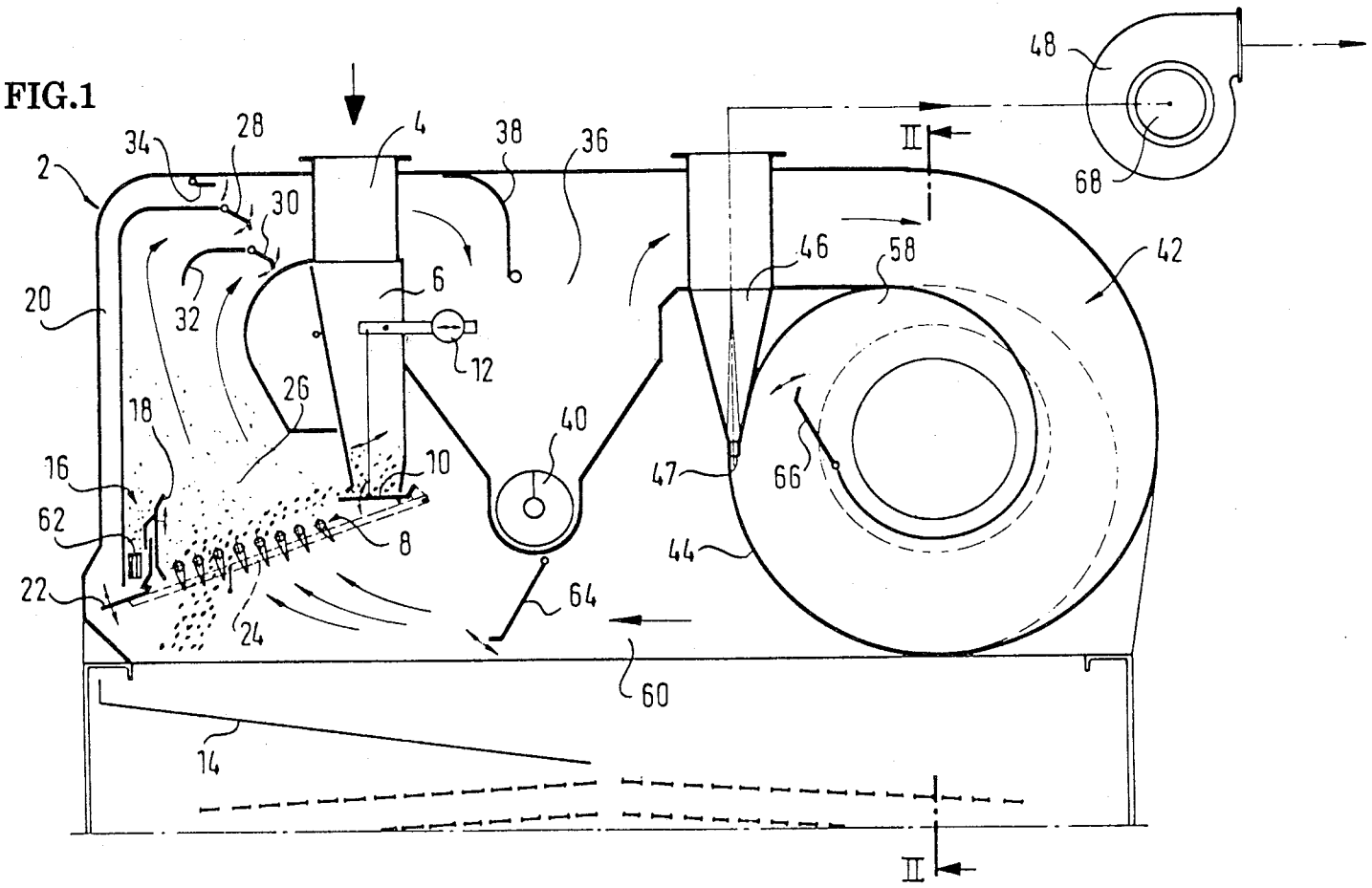
FIG. 1 is a sectional schematic view of a preferred embodiment of a separating apparatus constructed in accordance with the present invention.

Referring to the drawings, and particularly to FIG. 1, there is shown a separating apparatus in accordance with the present invention comprising a housing 2 having an inlet means or feed opening 4 for introducing particulate material into the housing 2. The inlet means or feed opening 4 includes a distributing container 6 from which the particulate material can be discharged over a screen or grid means 8 disposed within the housing 2. The grid means preferably slopes obliquely downward from the feed opening 6 in order to distribute the incoming particulate material uniformly over the upper surface of the grid means 8. At the lower end of the distributing container 6 is a feed flap 10, which is forced into its closed position by a balance weight 12. The particulate material is discharged from the distributing container onto the grid means 8 through the feed opening cross section, which is limited by the feed flap 10. When the particulate material falls upon the grid means 8, the heavier particles fall downwardly through the grid means 8 and into a sifter 14 which further separates or sizes the particulate material. A flow of carrier fluid or air passes upwardly through the grid means 8 to entrain and remove dust, dirt and light particles from the particulate material on the grid means 8. Because of the oblique position of the grid means 8, the particulate material is spread fanwise, causing some of the heavier particles to also be entrained by the upward air current, especially at a high particulate material feed rate. The heavier particles entrained by the air current, together with some of the lighter particles, precipitate from the upwardly passing carrier fluid and collect within a generally vertical collecting bin 16, which is installed within the housing 2 above the lower end of the grid means 8. The separating sidewall 18 of the collecting bin 16 is generally flared toward the feed flap 10 to define an inlet. The sidewall 18 is adjustable in height, whereby the fraction of the precipitated material entering the collecting bin 16 may be regulated.

The lower end of the collecting bin 16 has an outlet which includes an adjustable feed flap 22 for regulating the discharge of collected material from the collecting bin 16. The collected particulate material is discharged from the collecting bin 16 into a generally vertical separator conduit or rising separator 20. A portion of the carrier fluid enters the lower end of the separator conduit 20 and passes upwardly through the separator conduit 20 to entrain and remove dust, dirt and light particles from the material discharged from the collecting bin 16. The heavier particles which are discharged from the collecting bin 16 fall downwardly into the sifter 14.

In order to coordinate the flow of particulate material to the grid means with the charging of the rising separator 20, the two feed flaps 10 and 22 are operably connected with each other through a coupling rod 24. In this manner, the discharge cross sections of the feed opening 10 to the grid means 8 and of feed opening 22 the collecting bin 16 to the rising separator 20 are variable and, coupled with each other, so that they increase as the amount of the particulate material located in the feed opening 4 increases. Thus, the charging of the rising separator 20 also increases with increasing charging of the grid means 8.

The medium exit from the open space 26 above the grid means 8 is partially closed by two regulating flaps 28 and 30 and a curved baffle plate 32 therebetween. The medium exit from the rising separator 20 is correspondingly closed by a regulating flap 34.

Downstream from the regulating flaps 28, 30 and 34 there is a separator area 36 for the lighter grains. A curved baffle plate 38 directs the fluid carrier medium current, in the present instance air carrying the lighter particles, dust and dirt, downward into the separator area 36. When the air current impinges upon the baffle plate 38, it changes direction and most of the dirt and lighter particles are precipitated out of the airflow, and fall downwardly where they are discharged from the housing 2, for example, by a screw conveyor 40.

Downstream from the separating area 36 is a pneumatic centrifugal separator 42 which receives the air current, now carrying primarily just the dust. The centrifugal separator 42 guides the air along a screw narrowing toward the inside, whereby the dust is concentrated in a layer in the area of the outer centrifugal separator wall 44. In this manner, the dust enters a nozzle 46 through orifice 47 which is generally tangential to the inside of the centrifugal separator wall 44. A fan 48 is employed to extract the dust from the nozzle 46 and deliver it to a dust separator or filter (not shown).

Figure 2:
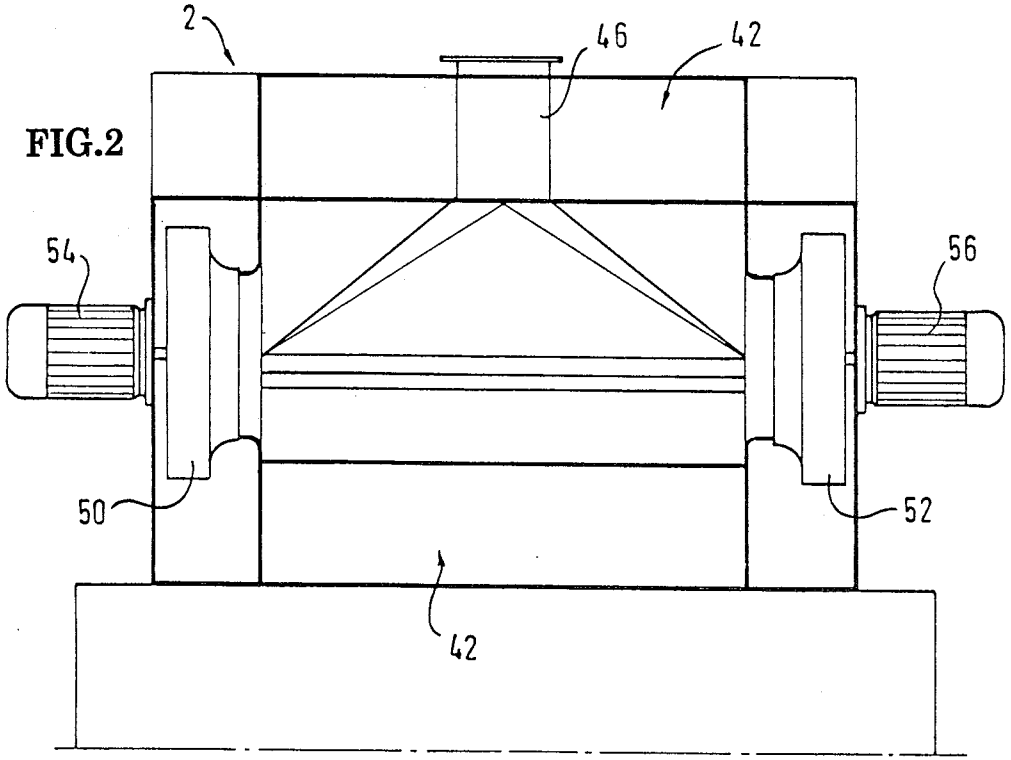
FIG. 2 is a sectional view taken along line II—II of FIG. 1.

As shown on FIG. 2, the centrifugal separator 42 is operated with two fans 50 and 52, which are driven by corresponding motors 54 and 56 installed on the two sides of the housing 2. The clean-air outlet 58 of the centrifugal separator 42 opens into the inlets of the fans discharge 50 and 52 and the fans discharge into a space 60 below the separator area 36, through which the air current is supplied to the bottom side of the grid means 8. In the clean-air outlet 58 there is a regulating flap 66. Another regulating flap 64 is located in the space 60 under the separator area 36.

Figure 3:
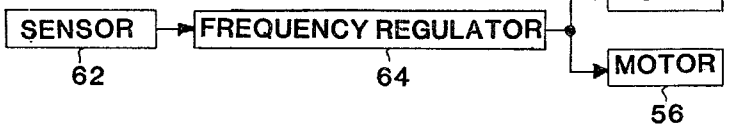
FIG. 3 is a block diagram illustrating one embodiment of the control means of the present invention.

A sensor means or filling height sensor 62, preferably of the capacitive type, is installed in the collecting bin 16 as shown. In order to prevent the collecting bin 16 from overflowing, the sensor means 62 senses the level of the material within the collecting bin 16 and actuates suitable control means in order to control the velocity of the carrier fluid flowing through the grid means 8 and separator conduit 20. For example, as diagrammed in FIG. 3, the sensor signal may be transmitted to a frequency regulator 64, which may regulate the frequency and thus the speed of rotation of the motor 54 and 56, thereby regulating the speed of the fans 50 and 52. The regulation takes place in such a way that the speed of rotation of the fans 50 and 52 decreases as the filling height in the collecting bin 16 increases. Conversely, the speed of rotation of the fans 50 and 52 increases with decreasing filling height in the collecting bin 16. Alternatively, or in addition, the air current which passes through the screen means 8 may be reduced or increased correspondingly by adjusting the various flaps 28, 30, 34, 64 and 66.

Thus, the sensor means in cooperation with the control means operates to constantly adjust the velocity of the carrier fluid flow in the chamber 26 in order to maintain maximum efficiency of operation regardless of the particle size or flow rate of the incoming particulate material. To prevent the carrier fluid flow from starting at maximum velocity at startup, the sensor means preferably includes a time delay to prevent such adjustment until the collecting bin 16 has become suitably filled.

From the foregoing description, it can be seen that the present invention comprises an apparatus for separating dust, dirt and the like from particulate material utilizing a flow of carrier fluid. It is apparent that the apparatus is self-adjusting for maximum operating efficiency without the need for constant supervision. It will be recognized by those skilled in the art that changes or modifications may be made to the above-described embodiment without departing from the broad inventive concepts of the invention. It is understood, therefore, that this invention is not limited to the particular embodiment disclosed, but it is intended to cover all modifications which are within the scope and spirit of the invention as defined by the appended claims.

I claim:

1. In an apparatus for separating dust, dirt and the like from particulate material utilizing a flow of carrier fluid comprising:

a housing having a carrier fluid inlet proximate the bottom and a carrier fluid outlet proximate the top;

inlet means for introducing particulate material into the housing;

grid means disposed within the housing below said inlet means and intermediate the fluid inlet and the fluid outlet to spread the material across the housing;

means to cause a regulated velocity of carrier fluid to flow upwardly through said grid means toward said fluid outlet whereby heavier particulate material falls through said grid means and lighter particulate material is entrained and carried upwardly by the fluid passing through said grid means to thereby separate dirt, dust and light particles from said heavier particulate material;

a generally vertical collecting bin within the housing, the bin having an inlet positioned to collect a portion of said entrained particulate material precipitating from said upwardly passing carrier fluid and an outlet for discharging a regulated amount of said collected particulate material;

a generally vertical separator conduit having a fluid inlet below said collecting bin, said bin outlet operable to discharge said collected material into said separator conduit, whereby the fluid passing upwardly through said separator conduit entrains dust, dirt and light particles from said discharged collected material;

sensor means within the collecting bin for sensing the level of said material therein; and control means actuated by the sensor means for controlling the velocity of the carrier fluid flowing through the housing, said control means operating to reduce the velocity of the carrier fluid as the level of collected material in the collecting bin increases.

2. The apparatus as recited in claim 1 wherein the collecting bin includes a sidewall which is adjustable in height in order to regulate the accumulation of particulate material within the bin.

3. The apparatus as recited in claim 1 wherein the inlet means includes first regulator means for controlling the flow of particulate material into the housing and the collecting bin outlet includes second regulator means for controlling the discharge of collected particulate material therefrom, said first and second regulating means being operatively coupled together.

4. The apparatus as recited in claim 1 wherein the grid means slopes obliquely downward from the inlet means and the collecting bin is positioned proximate the lower end of the grid means.

5. The apparatus as recited in claim 1 wherein the flow of carrier fluid is provided by means driven by an electrical motor and further including frequency regulator means for controlling the frequency of the electrical energy delivered to the motor whereby the control means controls the frequency regulator means.

* * * * *